US010543432B2

(12) United States Patent
Hashiba et al.

(10) Patent No.: US 10,543,432 B2
(45) Date of Patent: Jan. 28, 2020

(54) TOY TOP

(71) Applicant: TOMY COMPANY, LTD., Tokyo (JP)

(72) Inventors: Kenta Hashiba, Tokyo (JP); Makoto Muraki, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/992,255

(22) Filed: May 30, 2018

(65) Prior Publication Data

US 2018/0353867 A1 Dec. 13, 2018

(30) Foreign Application Priority Data

Jun. 9, 2017 (JP) ..... 2017-114591

(51) Int. Cl.
*A63H 1/04* (2006.01)
*A63H 1/02* (2006.01)

(52) U.S. Cl.
CPC ..... *A63H 1/04* (2013.01); *A63H 1/02* (2013.01)

(58) Field of Classification Search
CPC ..... A63H 1/00; A63H 1/04; A63H 1/02
See application file for complete search history.

(56) References Cited

U.S. PATENT DOCUMENTS 1,783,627 A * 12/1930 Raimondi ..... A63H 1/00 446/256
4,030,238 A * 6/1977 Lakin ..... A63H 13/04 446/36
4,772,241 A * 9/1988 Bro ..... A63H 1/08 446/202
6,520,827 B1 * 2/2003 Liu ..... A63H 1/00 446/124

(Continued)

FOREIGN PATENT DOCUMENTS

CN 2905160 Y 5/2007
CN 200977398 11/2007

OTHER PUBLICATIONS

Espacent English abstract for Chinese Patent Application No. 2905160Y, dated May 30, 2007.

(Continued)

*Primary Examiner* — Melba Bumgarner
*Assistant Examiner* — Amir A Klayman
(74) *Attorney, Agent, or Firm* — Staas & Halsey LLP

(57) ABSTRACT

A toy top includes a shaft portion, a body, and a first attacking member and a second attacking member that are disposed at different circumferential direction positions of the body. The first attacking member is movable between an inner first position and an outer second position in a radial direction. The second attacking member is movable between an inner third position and an outer fourth position in the radial direction. The first attacking member is biased toward (Continued)

the first position and is movable to the second position by centrifugal force. The second attacking member is restrained at the third position when the first attacking member is at the first position and is released from restraint to be moved to the fourth position when the first attacking member is at the second position.

17 Claims, 8 Drawing Sheets

(56) References Cited

U.S. PATENT DOCUMENTS

| | | | | |
|---|---|---|---|---|
| 6,746,300 | B1 * | 6/2004 | Matsukawa | A63H 1/06 446/256 |
| 7,740,518 | B2 * | 6/2010 | Elliott | A63F 9/16 273/126 R |
| 9,802,134 | B2 * | 10/2017 | Cai | A63H 1/02 |
| 9,895,620 | B1 * | 2/2018 | Walterscheid | A63H 1/24 |
| 10,029,185 | B2 * | 7/2018 | Cai | A63H 1/00 |
| 2011/0171876 | A1 * | 7/2011 | Ujita | A63H 1/00 446/264 |
| 2011/0256796 | A1 * | 10/2011 | Ujita | A63H 1/00 446/264 |

OTHER PUBLICATIONS

Extended European Search Report dated Aug. 20, 2018 in corresponding European Patent Application No. 18175929.1.
Espacenet Abstract for Chinese Patent Application No. 200977398, published Nov. 21, 2007.

* cited by examiner

TOY TOP

BACKGROUND OF THE INVENTION

1. Field of the Invention

The present invention relates to a toy top.

2. Description of Related Art

A battle game using toy tops that has been known in the art involves forcing toy tops to collide with each other so that a resultant impact force stops the spinning of an opponent toy top or knocks out or disassembles the opponent toy top.

Some of such toy tops are designed to include offensive strength and defensive strength that are changeable. An example toy top includes several movable fins (attacking members), which are ejected radially outward by the action of centrifugal force to work as attackers and are moved inwardly by biasing force of return springs to take a defensive position when the spin speed of the toy top decreases (e.g. CN200977398Y).

However, the toy top disclosed in CN200977398Y includes an increased number of components because each movable fin is provided with a return spring, which leads to complicated assembly work.

SUMMARY OF THE INVENTION

An object of the present invention, which has been made in view of such a drawback, is to provide a toy top that switches between offensive strength and defensive strength during spinning and includes a relatively small number of components to facilitate the assembly work.

According to an aspect of the present invention, a toy top includes:

a shaft portion; and a body having a first attacking member and a second attacking member that are disposed in different positions in a circumferential direction of the body, wherein the first attacking member is movable between an inner first position and an outer second position in a radial direction relative to the body, the second attacking member is movable between an inner third position and an outer fourth position in the radial direction, the first attacking member is biased toward the first position by a biasing force and is movable to the second position by centrifugal force, opposing the biasing force, and the second attacking member is restrained at the third position, when the first attacking member is at the first position, and is released from the restraint and moves to the fourth position, when the first attacking member is at the second position.

Preferably, the first attacking member includes a contact portion that contacts the second attacking member to restrain the second attacking member at the third position.

Preferably, a plurality of the first attacking members and a plurality of the second attacking members are continuously arranged in the circumferential direction of the body.

Preferably, at least one of the first attacking member and the second attacking member moves in the radial direction to protrude from an outer circumference of the body.

According to the configuration described above, the centrifugal force is high in the first half stage of spinning. Thus, the first and second attacking members each extend radially outward in a well-balanced manner such that the top toy has a circumferential shape with large depressions and projections, resulting in high offensive strength. The centrifugal force is low in the second half stage of the spinning. Thus, the first and second attacking members retract inwardly, and the center of gravity shifts inward. The toy top thereby has a circumferential shape with small depressions and projections, resulting in high defensive strength, high stability and continuity of spinning.

In this case, the second attacking members move in cooperation with the first attacking members; hence, no means for inwardly biasing the second attacking members is needed. Thus, the structure of the top toy is simple and can be readily assembled.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DESCRIPTION OF THE EMBODIMENTS

A toy top according to embodiments of the present invention will now be described with reference to the accompanying drawings.

Overall Configuration of First Embodiment

Figure 1:
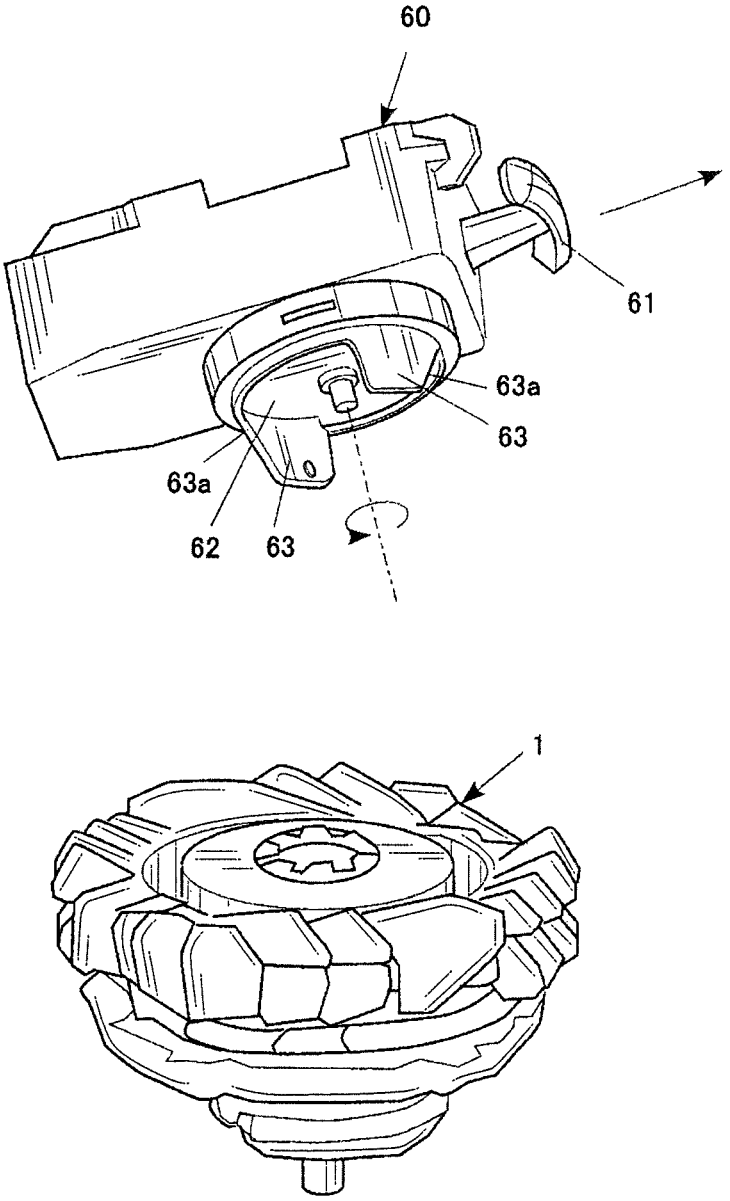
FIG. 1 is a perspective view of a toy top and a toy-top launcher according to a first embodiment.

FIG. 1 illustrates a toy set including a toy top 1 and a toy-top launcher 60 according to the first embodiment.

Figure 2:
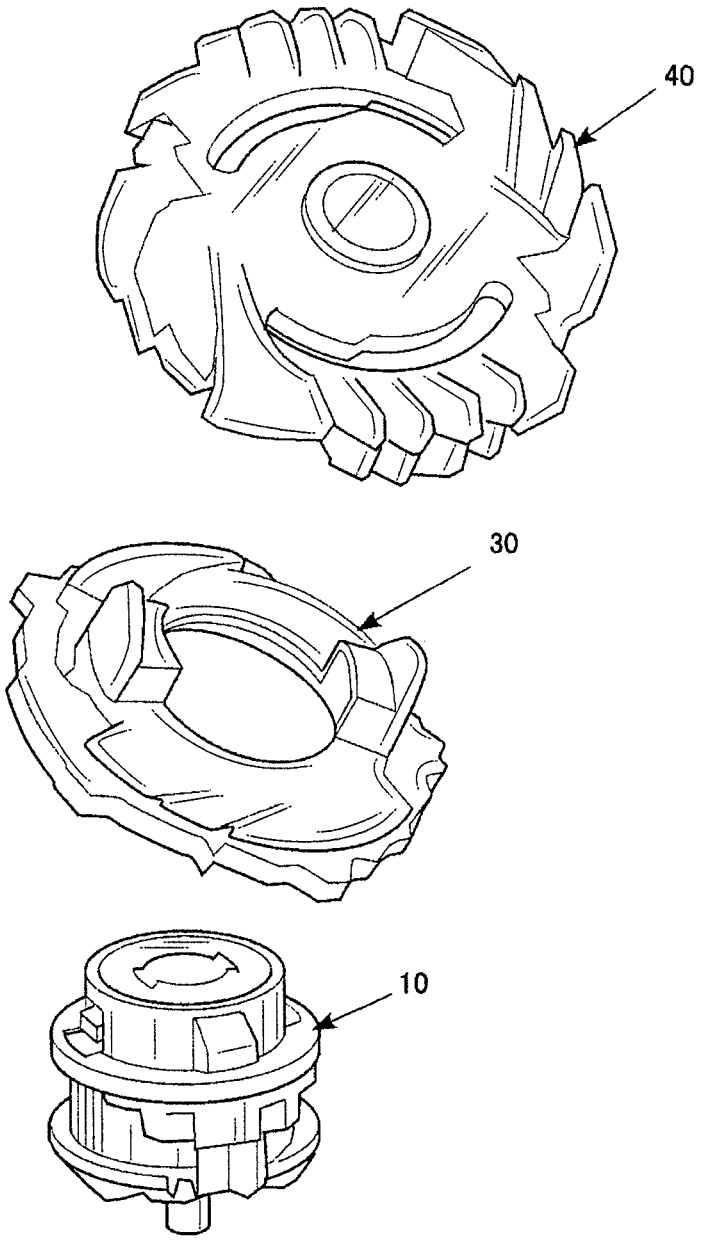
FIG. 2 is a perspective view of the toy top in action according to the first embodiment.

The toy top 1 is of a type that can be used in a so-called "top battle game." The toy top 1, for example, can be used in a battle game in which a player wins the game when an opponent toy top 1 is disassembled as illustrated in FIG. 2 by the impact force of a collision between toy tops.

With reference to FIG. 2, the toy top 1 is composed of a shaft portion 10, a flywheel 30, and a body 40.

Details

1. Shaft Portion 10

Figure 3:
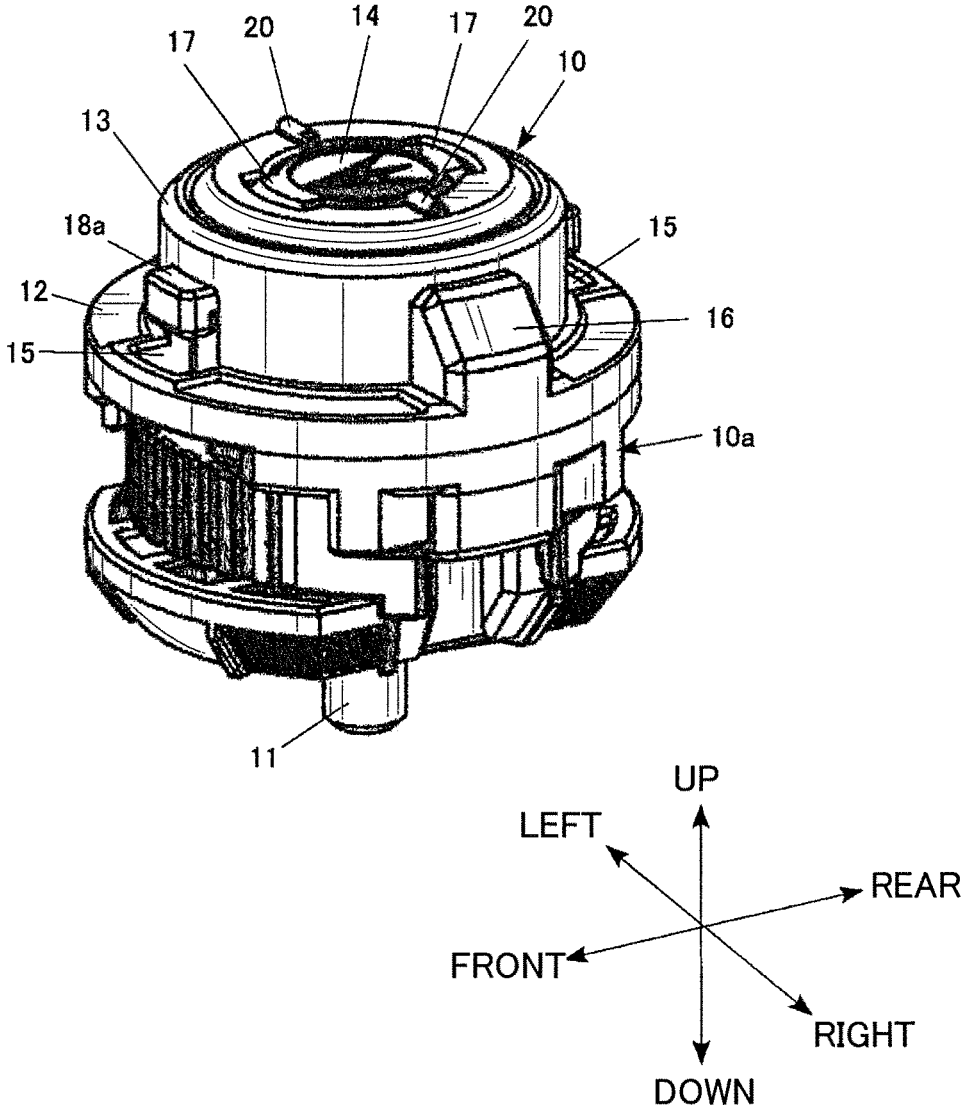
FIG. 3 is a perspective view illustrating a shaft portion of the toy top according to the first embodiment.
Figure 4:
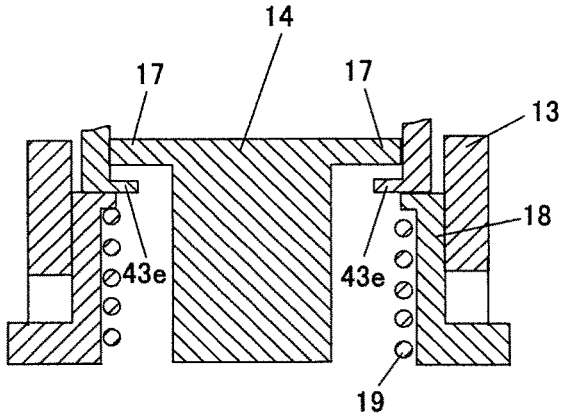
FIG. 4 is a cross-sectional view illustrating coupling of the shaft portion with a body of the toy top according to the first embodiment.

FIG. 3 is a perspective view of a shaft portion 10. FIG. 4 is a cross-sectional view illustrating coupling of the shaft portion 10 with the body 40. In the following description on the shaft portion 10, the terms "up-down", "right-left", and "front-rear" represent the respective directions as illustrated in the drawing.

The shaft portion 10 includes a ground contact or spinning shaft 11 in the lower end section, a flange 12 in the middle section in the up-down direction, and a cylinder 13 in the upper end section.

The flange 12 is integrated with the cylinder 13. The core of the cylinder 13 includes a post 14. The upper end of the post 14 has a large diameter. This large diameter portion has two hooks 17 protruding radially outward in the front and back directions. The post 14 is fixed to a lower shaft portion 10*a*. The lower shaft portion 10*a* is fixed to the flange 12 with, for example, a screw (not shown).

Two holes 15 are formed in the front and back regions across the flange 12 and the cylinder 13. The circumferential face of the cylinder 13 has two protrusions 16 in the right and left regions. The outer faces of the protrusions 16 are flush with the circumferential face of the flange 12.

The shaft portion 10 includes a cylindrical urging member 18. The urging member 18 includes an annular top panel that fits to the upper end portion of the post 14. The urging member 18 is hollow and has a downward opening. The urging member 18 fits inside the cylinder 13 and surrounds the post 14. The circumferential face at the lower end of the urging member 18 has two legs 18*a* protruding radially outward in the front and back directions.

With reference to FIG. 3, the urging member 18 is assembled such that the legs 18*a* are exposed from the respective holes 15. The holes 15 allow the respective legs 18*a* to move in the up-down direction therein. The upward movement, however, is limited by the upper edges of the holes 15. As shown in FIG. 4, the urging member 18 is urged upward by a spring 19. In a normal state, the upper end face of the urging member 18 is substantially flush with the upper edge of the cylinder 13.

The upper face of the urging member 18 has two ridges 20 radially extending in the left and right directions.

2. Flywheel 30

Figure 5:
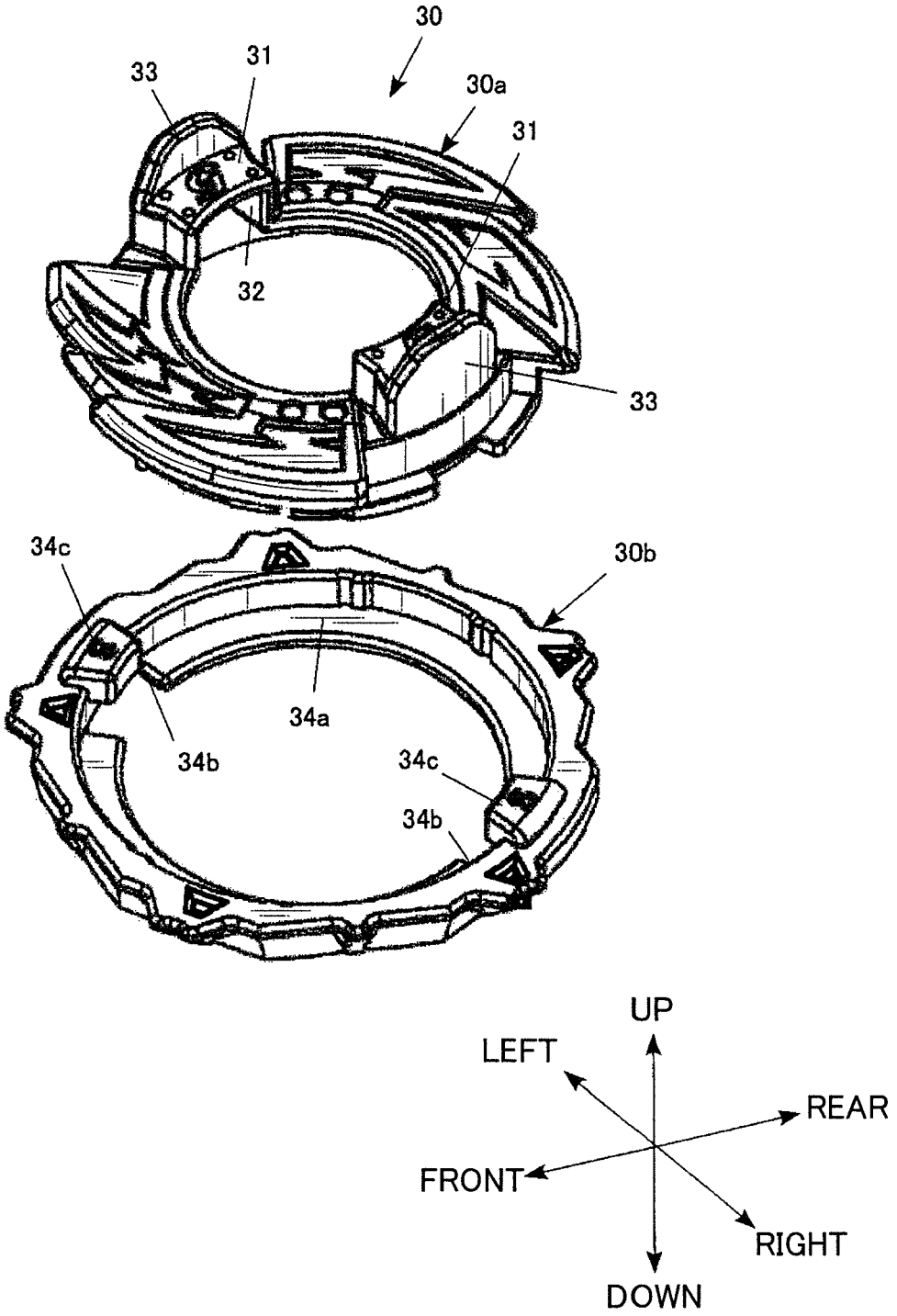
FIG. 5 is an exploded top-down perspective view illustrating a flywheel of the toy top according to the first embodiment.
Figure 6:
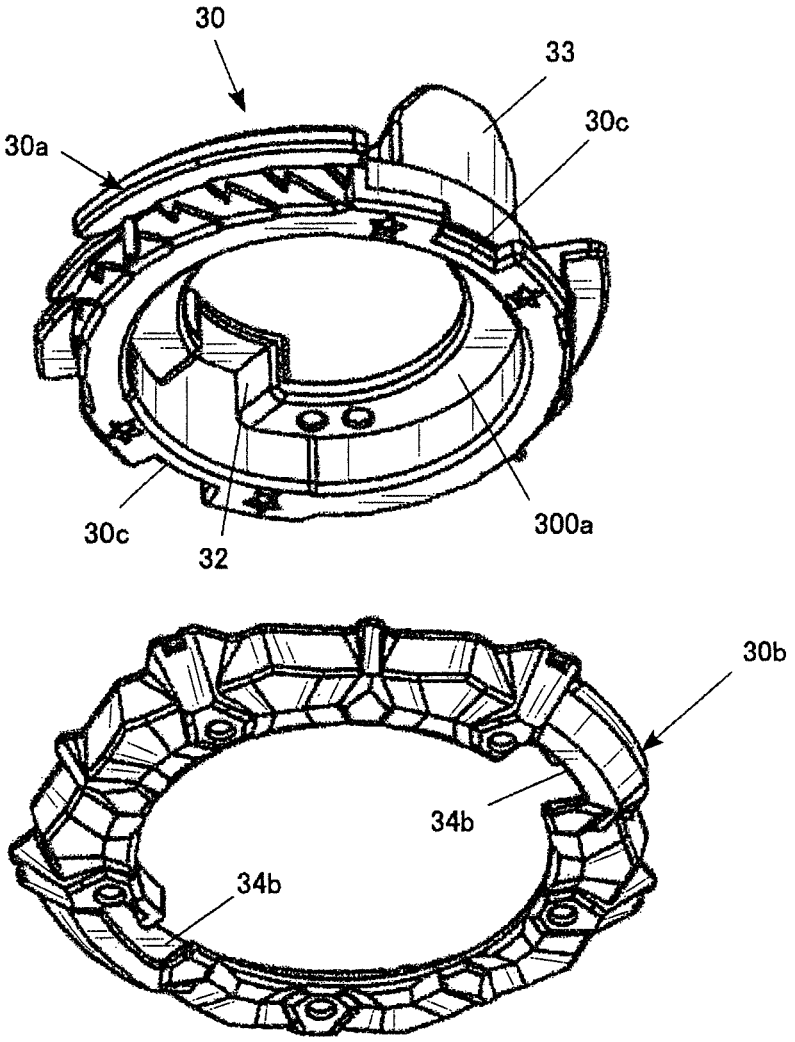
FIG. 6 is an exploded bottom-up perspective view of the toy top according to the first embodiment.

FIG. 5 is an exploded top-down perspective view of the flywheel 30. FIG. 6 is an exploded bottom-up perspective view of the flywheel 30. In the following description on the flywheel 30, the terms "up-down", "right-left", and "front-rear" represent the directions as illustrated in FIG. 5.

The flywheel 30 includes a flywheel body 30*a* and a wheel cover 30*b*. The flywheel 30 may include any other component.

The flywheel body 30*a* has an annular shape. The inner bottom face of the flywheel body 30*a* has an annular step 300*a* that accommodates the flange 12 of the shaft portion 10 disposed below. The upper face of the flywheel body 30*a* has two upward protrusions 31 extending in the right and left directions, respectively. Recesses 32 that accommodate the respective protrusions 16 of the shaft portion 10 from below are defined inside the protrusions 31. The upper face of the flywheel body 30*a* has tongues 33 adjoining the outer faces of the protrusions 31 and extending upward. The tongues 33 protrude above the protrusions 31.

The flywheel body 30*a* overlies an annular wheel cover 30*b* that is fitted into the exterior of the flywheel body 30*a*. The wheel cover 30*b* has an annular step 34*a* on which the flywheel body 30*a* sits. The wheel cover 30*b* also has two notches 34*b* defined in the right and left regions of the step 34*a* of the wheel cover 30*b*. The wheel cover 30*b* also has projections 34*c* on the respective notches 34*b*. The projections 34*c* correspond to respective notches 30*c* provided in the outer circumference of the flywheel body 30*a*. The notches 30*c* of the flywheel body 30*a* are aligned with the respective projections 34*c* in the vertical direction. After the flywheel body 30*a* is fitted to the wheel cover 30*b*, the wheel cover 30*b* is rotated by a predetermined angle relative to the flywheel body 30*a* in a predetermined direction. The wheel cover 30*b* is thereby mounted to the flywheel body 30*a*.

3. Body 40

Figure 7:
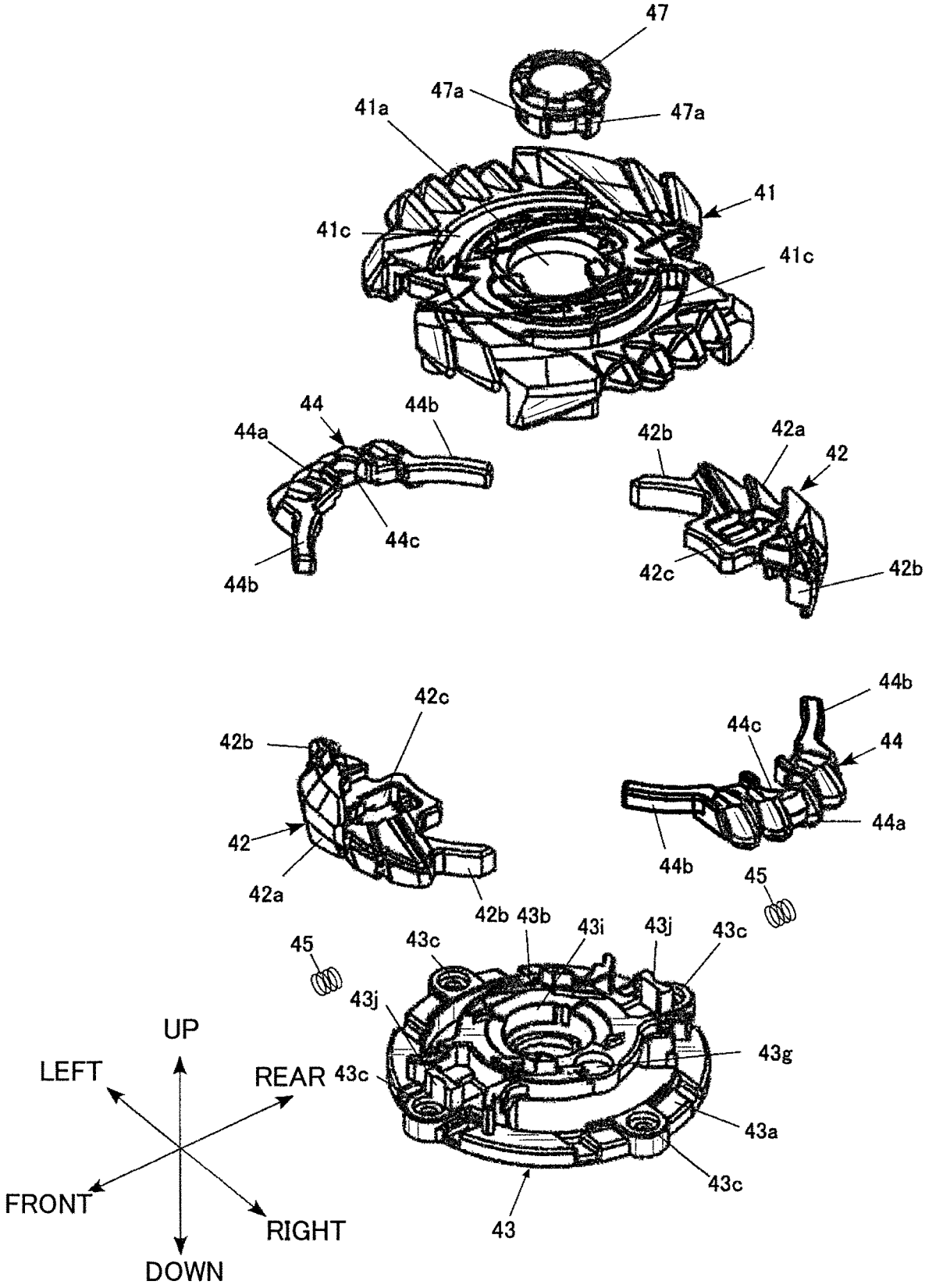
FIG. 7 is an exploded top-down perspective view of the body of the toy top according to the first embodiment.
Figure 8:
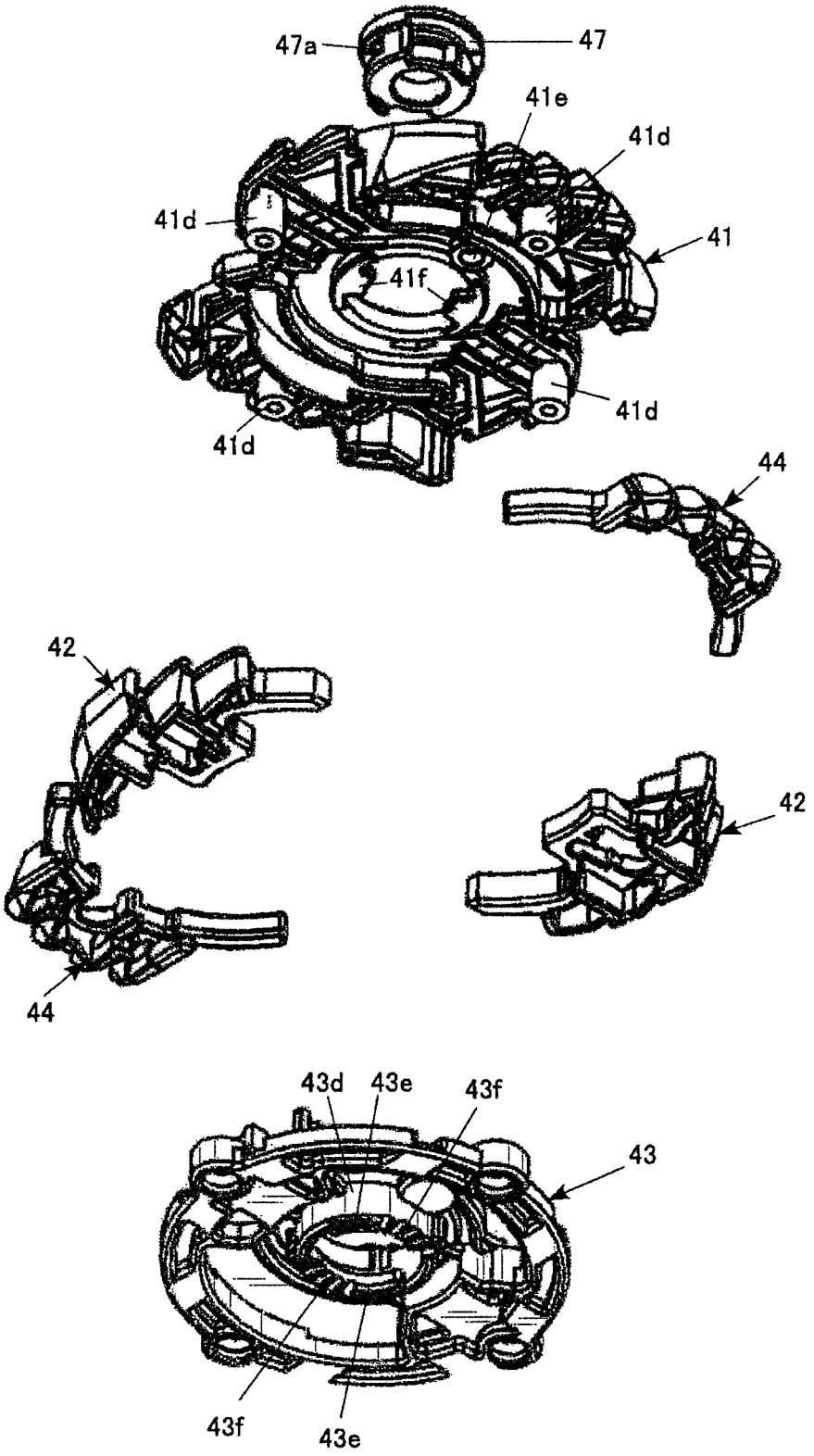
FIG. 8 is an exploded bottom-up perspective view illustrating the body of the toy top according to the first embodiment.

FIG. 7 is an exploded top-down perspective view of the body 40. FIG. 8 is an exploded bottom-up perspective view of the body 40. In the following description on the body 40, the terms up-down, right-left, and front-rear represent the directions as illustrated in FIG. 7.

As illustrated in FIGS. 7 and 8, the body 40 includes a top plate 41, a bottom plate 43, and first attacking members 42 and second attacking members 44 between the top plate 41 and the bottom plate 43. The top plate 41 and the bottom plate 43 define a main component.

(1) Top Plate 41

The top plate 41 has a substantially circular hole 41*a* defined in the center. The top plate 41 also has arcuate slits 41*c* in the right and left regions on the upper wall. The tongues 33 of the flywheel 30 can be inserted into the arcuate slits 41*c*. The width of each arcuate slit 41*c* is large at one end and small at the other end in the circumferential direction.

The bottom face of the top plate 41 has four cylindrical bosses 41*d* disposed in the circumferential direction at predetermined intervals. The inner wall of the hole defined in the center of each boss 41*d* has an internal thread (not shown). The bottom face of the top plate 41 has a positioning boss 41*e*.

The top plate 41 also has projections 41*f* in the right and left regions of the wall defining the hole 41*a*.

(2) Bottom Plate 43

The bottom plate 43 includes an annular frame 43*a*. A connector 43*b* supporting the frame 43*a* is disposed inside of the frame 43*a*. The connector 43*b* has a hole 43*i* in the center.

The frame 43*a* has four counterbored through-holes 43*c* that are disposed at predetermined intervals in the circumferential direction and correspond to the respective bosses 41*d*, which are inserted into the counterbored through-hole 43*c*. The bottom plate 43 and the top plate 41 hold the attacking members 42 and 44 therebetween. An external thread (not shown) fed through the through-holes 43*c* on the bottom plate 43 is screwed with the internal thread in the bosses 41*d* on the top plate 41, and the bottom plate 43 is thereby mounted to the top plate 41.

The bottom face of the bottom plate 43 has an annular wall 43*d* having a diameter equal to that of the hole 43*i*. The lower inner face of the annular wall 43*d* has two hooks 43*e* disposed opposite each other across the core and extending radially inward. One end of the lower face of each hook 43*e* has undulations 43*f* that engage with the ridges 20 of the shaft portion 10. The undulations 43*f* include several ridges disposed in the circumferential direction.

The upper face of the connector 43*b* has a hole 43*g* that fits to the positioning boss 41*e*.

(3) First and Second Attacking Members 42 and 44

The first attacking members 42 and the second attacking members 44 are disposed between the top plate 41 and the bottom plate 43. The first attacking members 42 are disposed in the front and rear. The second attacking members 44 are disposed in the right and left regions. The first attacking members 42 each have a generally arcuate shape and include an attacker 42*a* disposed in the center and protruding radially outward. The first attacking members 42 include contact pieces 42*b* at both ends of the attacker 42*a*. The first attacking members 42 are movable between a first inner position (FIG. 9A) and a second outer position (FIG. 9B) in a radial direction of the toy top 1. The second attacking members 44 each have a generally arcuate shape and include an attacker 44*a* disposed in the center and protruding radially outward. The second attacking members 44 include contact pieces 44*b* at both ends of the attacker 44*a*. The second attacking members 44 are movable between a third inner position (FIG. 9A) and a fourth radially outward position (FIG. 9B) of the toy top 1.

The attackers 42*a* of the first attacking members 42 and the attackers 44*a* of the second attacking members 44 protrude radially outward from the main component when the first and second attacking members 42 and 44 reside at the outer positions in radial directions.

The interior of the attacker 42*a* of each first attacking member 42 has a window 42*c*. The boss 41*d* of the top plate 41 and a projection 43*j* on the bottom plate 43 are disposed in the window 42*c*. A spring (return spring) 45 is disposed between the inner wall of the window 42*c* and the projection 43*j*. The first attacking member 42 is thereby biased inward. Furthermore, the first attacking member 42 is radially guided by the boss 41*d*. The interior of the attacker 44*a* of each second attacking member 44 has a recess 44*c* that is opened and faces the axis of the toy top 1. The boss 41*d* on the bottom plate 43 is disposed in the recess 44*c*. Thereby, the boss 41*d* radially guides the second attacking member 44.

The second attacking member 44 is mounted to the main component such that the contact piece 44*b* of the second attacking member 44 is disposed more inward than the contact piece 42*b* of the first attacking member 42. The second attacking member 44 is restrained at the third position when the first attacking member 42 resides at the first position by the biasing force of the spring 45. The second attacking member 44 is released from the restraint at the third position and can be moved by the centrifugal force to the fourth position when the first attacking member 42 resides at the second position in opposition to the biasing force of the spring 45.

(4) Decorative Component 47

A decorative component 47 is attached to the hole 41*a* in the top plate 41. The decorative component 47 is provided for distinguishing the toy top 1 from an opponent toy top. Multiple decorative components having upper faces of different colors and/or shapes may be provided. The decorative component 47 has curved grooves 47*a* in the circumference. The decorative component 47 is inserted into the hole 41*a* in the top plate 41 and rotated in a predetermined direction such that the projections 41*f* are engaged with the grooves 47*a*. The decorative component 47 is thereby mounted to the top plate 41.

4. Assembly of Toy Top 1

In the first stage, the protrusions 16 of the shaft portion 10 are aligned with the respective recesses 32 of the flywheel 30 from below, so as to fit the shaft portion 10 with the flywheel 30. In the second stage, this shaft portion/flywheel combination is moved close to the body 40 from below.

The tongues 33 of the flywheel 30 are then inserted into the respective arcuate slits 41*c* in the body 40. In this state, the hooks 17 of the shaft portion 10 are not aligned with the hooks 43*e* of the body 40 in the up-down direction. This state is referred to as a decoupled state. The shaft portion 10 of the fitted body is then urged toward the body 40. In response, the flywheel 30 is urged against the bottom face of the body 40. The spring 19 in the shaft portion 10 then contracts, and the urging member 18 sinks. This causes the hooks 17 of the shaft portion 10 to be relatively urged above the hooks 43*e* of the body 40. The shaft portion 10 is turned together with the flywheel 30 in a predetermined direction (the direction opposite to the rotating direction of the toy top 1) relative to the top plate 41 and the bottom plate 43. This causes the hooks 43*e* of the body 40 to move beneath the hooks 17 of the shaft portion 10, such that the hooks 17 are aligned with the hooks 43*e* in the up-down direction. In response to the removal of the hand of the player from the shaft portion 10, the lower faces of the hooks 17 of the shaft portion 10 come into contact with the upper faces of the hooks 43*e* of the body 40 due to the urging force of the spring 19 inside the shaft portion 10 (FIG. 4). This state in which the lower faces of the hooks 17 of the shaft portion 10 are in contact with the upper faces of the hooks 43*e* of the body 40 is referred to as a coupled state. As a result, the ridges 20 engage with the undulations 43*f*, and the toy top 1 is assembled. In this state, the first attacking member 42 resides at the first position via the biasing force of the spring 45. As a result, the first attacking member 42 is restrained at the third position by the second attacking member 44.

5. How to Play

An example of how to play with the toy top 1 will now be described.

FIG. 1 is a perspective view of an exemplary launcher that rotationally drives the toy top 1.

In this example of how to play, the toy top 1 is spun to engage in a battle with an opponent toy top 1.

In such a case, the rotational force of the toy top 1 is generated with a launcher 60, such as that illustrated in FIG. 1. The launcher 60 includes an internal disk (not shown). The disk is urged in a first rotational direction by a spiral spring (not shown). A handle 61 is then pulled to pull a string (not shown) wound around the disk so as to spin the disk, thereby spinning a top holder 62. The spinning of the top holder 62 is transmitted to the toy top 1 through forks 63 protruding downward so as to spin the toy top 1. In such a case, the forks 63 are inserted into the arcuate slits 41*c* in the body 40. Fully pulling the handle 61 of the launcher 60 stops the spinning of the disk and thus the spinning of the top holder 62, but the toy top 1 continues to spin due to inertia. The toy top 1 follows tilting faces 63*a* of the fork 63 and detaches from the top holder 62.

Figure 9A:
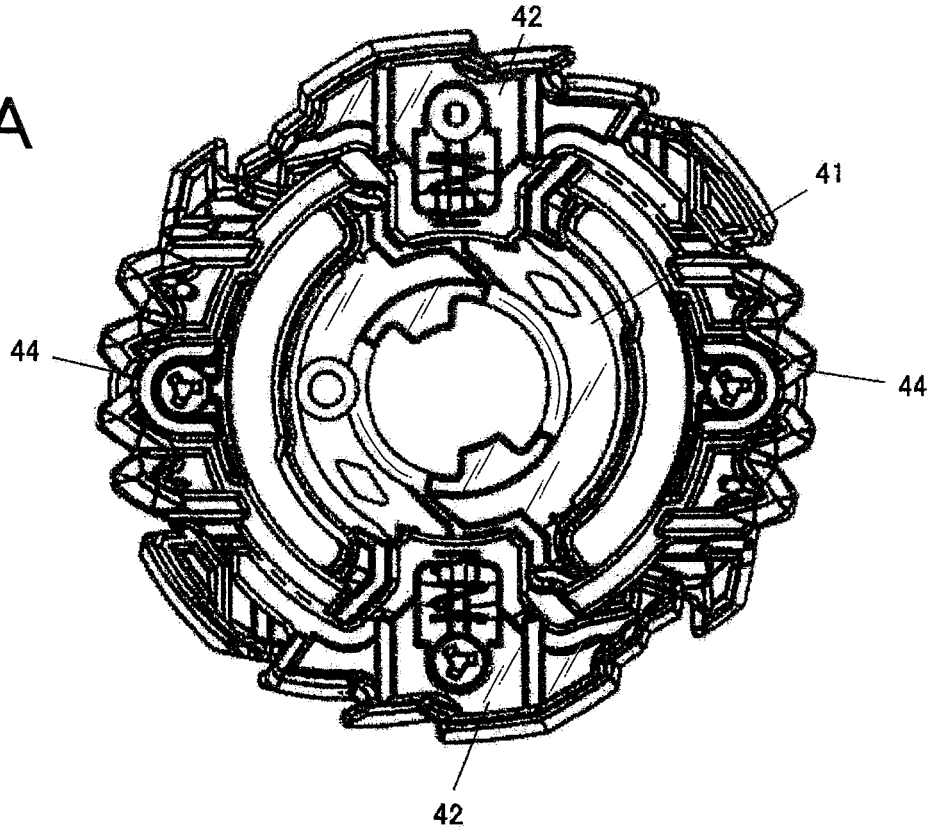
FIG. 9A is a plan view explaining the operation of attacking members of the toy top according to the first embodiment and illustrating the spin in the second half stage.
Figure 9B:
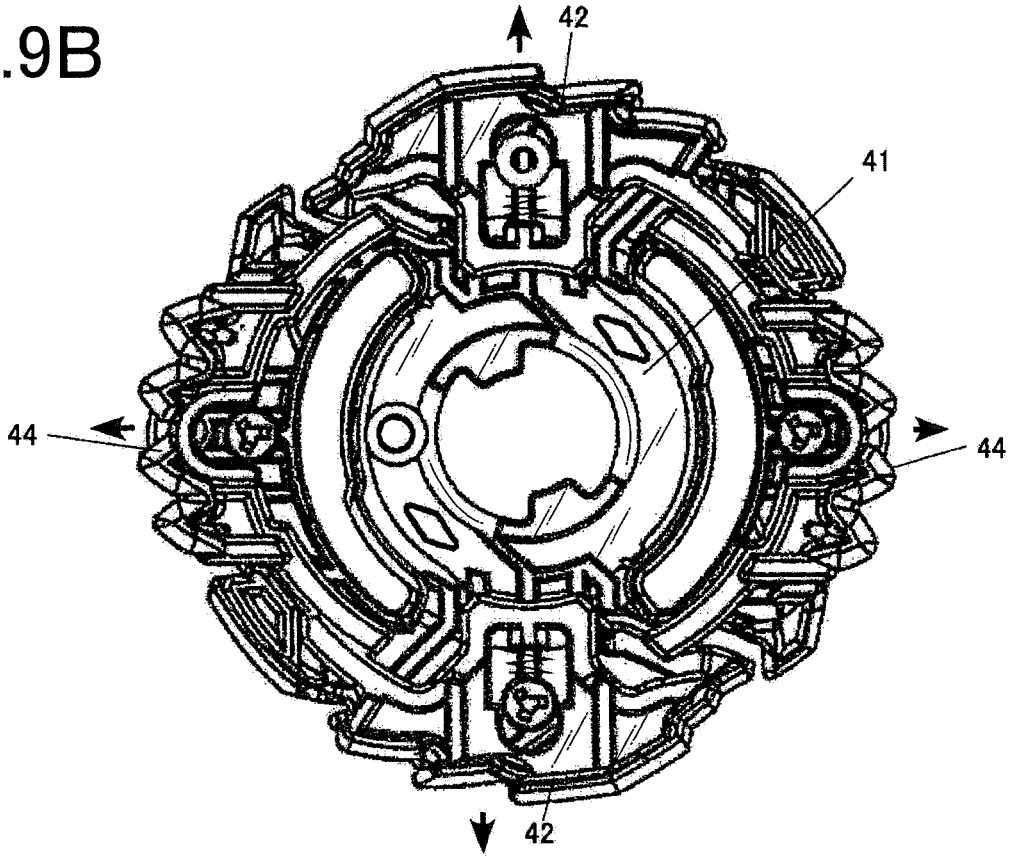
FIG. 9B is a plan view explaining the operation of the attacking members of the toy top according to the first embodiment and illustrating the spin in the first half stage.

The toy top 1 launched in this manner spins in a predetermined field in a predetermined direction. The first attacking members 42 are then moved by the centrifugal force from the first position to the second position as shown in FIG. 93. Meanwhile, the second attacking members 44 are released from the restraint in the first attacking members 42 by the movement of the first attacking members 42 to the second position and are moved by the centrifugal force to the fourth position. This causes the first and second attacking members 42 and 44 to move radially outward, resulting in a high offensive strength. If the centrifugal force is reduced by the decreased speed in the second half stage of spinning of the toy top, the biasing force of the spring 45 overcomes the centrifugal force, which causes the first attacking member 42 to move to the first position as shown in FIG. 9A. The second attacking members 44 are then returned to the third position by the biasing force of the spring 45 via the first attacking members 42.

If the toy top 1 collides with, for example, the opponent toy top 1 spinning in an identical direction, the impact force due to the collision causes a force that is reverse to the spin direction of the shaft portion 10 and flywheel 30 to be applied on the top plate 41 and the bottom plate 43. This causes the top plate 41 and the bottom plate 43 to relatively spin in the direction reversed to the spin direction of the shaft portion 10 and the flywheel 30.

The undulations 41*f* on the bottom face of the bottom plate 43 and the ridges 20 stepwise vary the engagement position of the undulations 41*f* with the projections 20 in cooperation with relative rotation of the shaft portion 10 to the top plate 41 and the bottom plate 43. The undulations 41*f* are disengaged from the projections 20 when they reach the decoupling position.

Advantageous Effect of Embodiment

In accordance with the toy top 1 according to the present embodiment, the centrifugal force is high in the first half stage of spinning. Thus, the first and second attacking members 42 and 44 each extend radially outward in a well-balanced manner such that the top toy 1 has a circumferential shape with large depressions and projections, resulting in a high offensive strength. The centrifugal force is low in the second half stage of spinning. Thus, the first and second attacking members 42 and 44 are retracted inward, and the center of gravity shifts inward. The toy top 1 thereby has a circumferential shape with small depressions and projections, resulting in a high defensive strength, increased stability and continuity of spinning.

In this case, the second attacking members 44 move in cooperation with the first attacking members 42; hence, a means for inwardly biasing the second attacking members 44 is not needed. Thus, the structure of the top toy 1 is simple, and can be readily assembled. This is particularly effective for the toy top 1 according to the present embodiment where the components within the second attacking member 44, such as the arcuate slits 41*c*, cannot be provided with a biasing means.

ALTERNATE EMBODIMENTS OF THE INVENTION

Although the embodiment according to the present invention has been described, the invention may include any other embodiment, and various modifications may be made without departing from the spirit of the invention.

For example, in the embodiment described above, two first attacking members 42 and two second attacking members are provided. Alternatively, any other number of the first and second attacking members 42 and 44 may be provided so long as they move in cooperation with each other.

In the embodiment, the main component (first body part) includes the top plate 41 and the bottom plate 43. Alternatively, the main component may include only one of the top plate 41 or the bottom plate 43.

In the embodiment, both the first attacking members 42 and the second attacking members 44 are radially movable. Alternatively, at least one of the first attacking members 42 and the second attacking members 44 may be rotatable around a predetermined axis. Any configuration may be employed so long as the attackers 42*a*, 44*a* radially move.

In the described embodiment, the first attacking members and the second attacking members 44 are continuously arranged along the circumferential direction of the body 40. Alternatively, the first attacking members 42 and the second attacking members 44 may be arranged at predetermined intervals in the circumferential direction. Any configuration may be employed so long as the first attacking members 42 are engaged with the second attacking members 44 and the first attacking members 42 move in cooperation with the second attacking members 44.

In the embodiment, the first attacking members 42 protrude from the main component even if they reside at the inner positions. Alternatively, at least one of the first attacking members 42 and the second attacking members 44 may protrude from the main component only when either of them move to a radially outward position.

The entire disclosure of Japanese patent application No. 2017-114591, filed on Jun. 9, 2017, is incorporated herein by reference in its entirety.

What is claimed is:

1. A toy top, comprising:

a shaft portion;

a body having a first attacking member and a second attacking member that are disposed in different positions in a circumferential direction of the body; and an opening formed on each of the first and second attacking members that receives in sliding relation, respectively, a projection projecting from the body, so that each of the first and second attacking members can be guided in a radial direction relative to the body, wherein the first attacking member is movable between an inner first position and an outer second position in the radial direction, the second attacking member is movable between an inner third position and an outer fourth position in the radial direction, the first attacking member is biased toward the inner first position by a biasing force and is movable to the outer second position by centrifugal force, opposing the biasing force, and the second attacking member is restrained at the inner third position, when the first attacking member is at the inner first position, and is released from being restrained and moves to the outer fourth position, when the first attacking member is at the outer second position, the first attacking member has a contact portion that contacts the second attacking member to restrain the second attacking member at the inner third position, and the second attacking member has a contact portion that is positioned more radially inward than the contact portion of the first attacking member, and the second attacking member is restrained from movement from the inner third position to the outer fourth position by the radially outward contact portion of the first attacking member contacting and blocking movement of the contact portion of the second attacking member.

2. The toy top according to claim 1, wherein at least one of the first attacking member and the second attacking member moves in the radial direction to protrude from an outer circumference of the body.

3. The toy top according to claim 1, wherein the biasing force is provided by a spring received by the body.

4. The toy top according to claim 1, wherein the projection is a boss.

5. The toy top according to claim 1, wherein the first attacking member protrudes from the body when in the inner first position.

6. The toy top according to claim 1, wherein the second attacking member protrudes from the body when in the inner third position.

7. The toy top according to claim 1, wherein the first attacking member is recessed within the body when in the inner first position.

8. The toy top according to claim 1, wherein the second attacking member is recessed within the body when in the inner third position.

9. The toy top according to claim 1, wherein, after the first attacking member moves from the inner first position to the outer second position, the biasing force moves the first attacking member from the outer second position to the inner first position, while the contact portion of the first attacking member pushes the contact portion of the second attacking member thereby pushing the second attacking member from the outer fourth position back to the inner third position.

10. A toy top, comprising:

a shaft portion;

a body having a plurality of first attacking members and a plurality of second attacking members that are disposed in different positions in a circumferential direction of the body; and an opening formed on each of the first and second attacking members that receives in sliding relation, respectively, a projection projecting from the body, so that each of the first and second attacking members can be guided in radial direction relative to the body, wherein each of the first attacking members is movable between an inner first position and an outer second position in the radial direction, wherein each of the second attacking members is movable between an inner third position and an outer fourth position in the radial direction, wherein each of the first attacking members is biased toward the inner first position by a biasing force and is movable to the outer second position by centrifugal force, opposing the biasing force, and wherein each of the second attacking members is restrained at the inner third position by one of the first attacking members, respectively, when each of the one first attacking members is at the inner first position, and is released from being restrained and moves to the outer fourth position, when each of the one of the first attacking members moves to the outer second position, wherein each of the first attacking members has a contact portion that comes into contact with a contact portion of each of the second attacking members to respectively restrain the second attacking member at the inner third position, wherein the plurality of the first attacking members and the plurality of the second attacking members are continuously arranged in the circumferential direction of the body, and wherein the contact portion of each of the plurality of second attacking members is positioned more radially inward than the contact portion of each of the plurality of the first attacking members, and each of the second attacking members is restrained from movement from the inner third position to the outer fourth position by the radially outward contact member of each of the first attacking members contacting and blocking radial movement of the contact member of each of the plurality of second attacking members.

11. The toy top according to claim 10, wherein the number of the plurality of the first attacking members is two, the number of the plurality of the second attacking members is two, the two first attacking members are located radially opposite each other on the body, the two second attacking members are located radially opposite each other on the body, and each of the two second attacking members is located between the two first attacking members.

12. The toy top according to claim 11, wherein the two first and two second attacking members are equally radially spaced in the circumferential direction of the body.

13. The toy top according to claim 10, wherein the body comprises a first upper plate connected to a second lower plate, and the pluralities of first and second attack members are located between the first upper plate and the second lower plate.

14. The toy top according to claim 10, wherein each of the first and second attack members has a generally arcuate shape with a central portion protruding radially outward, the contact portion is two elongated contact end pieces, and the central portion is between the two elongated contact end pieces.

15. The toy top according to claim 10, wherein at least one of the plurality of first attacking members and the plurality of second attacking members is rotatable about a predetermined axis to move radially outward.

16. The toy top according to claim 10, wherein, after each of the first attacking members moves from the inner first position to the outer second position, the biasing force moves each of the first attacking members from the outer second position to the inner first position, while the contact portion of each of the first attacking members pushes the respective contact portions of the second attacking members thereby pushing the second attacking member from the outer fourth position back to the inner third position.

17. The toy top according to claim 10, wherein the projection is a boss.

* * * * *